US006456252B1

(12) United States Patent
Goyette

(10) Patent No.: US 6,456,252 B1
(45) Date of Patent: Sep. 24, 2002

(54) PHASE-ONLY RECONFIGURABLE MULTI-FEED REFLECTOR ANTENNA FOR SHAPED BEAMS

(75) Inventor: Guy Goyette, Marina Del Rey, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/694,994

(22) Filed: Oct. 23, 2000

(51) Int. Cl.[7] ..... H01Q 13/00
(52) U.S. Cl. ..... 343/779; 343/853
(58) Field of Search ..... 343/853, 779, 343/778, 781 R, 782, 840

(56) References Cited

U.S. PATENT DOCUMENTS 5,818,388 A * 10/1998 Lane et al. ..... 342/373
5,936,592 A * 8/1999 Ramanujam et al. ..... 343/853
6,240,072 B1 * 5/2001 Lo et al. ..... 370/316

* cited by examiner

*Primary Examiner*—Don Wong
*Assistant Examiner*—Hoang Nguyen
(74) *Attorney, Agent, or Firm*—Gates & Cooper LLP

(57) ABSTRACT

A method and apparatus for reconfigurably transmitting shaped beam satellite signals via reflector array antennas are disclosed. The apparatus comprises a reflector for reflecting RF signals having a reflector focal plane and a feed array comprising a plurality of feed elements wherein said feed array is defocused from said reflector focal plane, yet produces a wavefront substantially similar to a wavefront that would be produced by a feed array located at the reflector focal plane. The method of transmitting a signal in accordance with the present invention comprises forming a wavefront with a feed array, wherein said feed array is defocused from a reflector focal plane, yet produces a wavefront substantially similar to a wavefront that would be produced by a feed array located at the reflector focal plane and reflecting said wavefront to a coverage area.

26 Claims, 10 Drawing Sheets

PHASE-ONLY RECONFIGURABLE MULTI-FEED REFLECTOR ANTENNA FOR SHAPED BEAMS

BACKGROUND OF THE INVENTION

1. Field of the Invention

The present invention relates to systems and methods for transmitting satellite signals, and in particular to a system and method for reconfigurably transmitting shaped beam satellite signals via reflector array antennas.

2. Description of the Related Art

Communications satellites are in widespread use. The communications satellites are used to deliver television and communications signals around the Earth for public, private, and military uses.

The primary design constraints for communications satellites are antenna beam coverage and radiated Radio Frequency (RF) power. These two design constraints are typically thought of to be paramount in the satellite design because they determine which customers on the Earth will be able to receive satellite communications service. Further, the satellite weight becomes a factor, because launch vehicles are limited as to how much weight can be placed into orbit.

Many satellites operate over fixed coverage regions, such as the Continental United States (CONUS), and employ polarization techniques, e.g. horizontal and vertical polarized signals, to increase the number of signals that the satellite can transmit and receive. These polarization techniques use overlapping reflectors where the reflector surfaces are independently shaped to produce substantially congruent coverage regions for the polarized signals. This approach is limited because the coverage regions are fixed and cannot be changed on-orbit, and the cross-polarization isolation for wider coverage regions is limited to the point that many satellite signal transmission requirements cannot increase their coverage regions.

Many satellite systems would be more efficient if they contained antennas with an on-orbit reconfigurable beam, capable of modifying the shape and translation (or scan) of the beam on the Earth. These objectives are typically met using a multi-feed reflector antenna system that reconfigures the beam coverage by individually varying signal amplitude with variable attenuators or amplifiers and varying the signal phase with variable phase shifters at the feed elements located along the reflector focal plane.

However, the antenna feed system and beamforming network (BFN) of such prior art multi-feed reflector antennas is complex, lossy, heavy, difficult to integrate, test, and repair or replace, requiring excessive time and labor costs. Furthermore, the complexity of the antenna feed system of such prior art multi-feed reflector antenna systems makes them more difficult to operate. Particularly, the amplifiers of prior art multi-feed reflector antenna systems do not operate at a fixed power level when reconfiguring the beam coverage. In addition, reconfiguring the beam coverage of prior art multi-feed reflector antenna systems requires switching power among a plurality of feeds.

Another approach to meet the previous beam reconfigurability objectives is to use a Direct Radiating Array (DRA). In the DRA solution, no reflector is used. The feed elements are arranged in a grid pattern and pointed directly at the coverage area. The antenna beam phase can be reconfigured by varying the excitation phase at the feed elements with variable phase shifters. The disadvantage of this solution is that to obtain the same directivity as a reflector antenna, a very large number of feed elements and phase shifter are needed, making such an antenna system very heavy and complex.

There is therefore a need in the art for a reconfigurable multi-feed reflector antenna system without the attendant complexity of prior art systems. There is also a need in the art for a reconfigurable multi-feed reflector antenna system that is easier to integrate and test. There is a further need in the art for a reconfigurable multi-feed reflector antenna system using amplifiers operating at a fixed gain. There is yet another need in the art for a reconfigurable multi-feed reflector antenna system that is reconfigured without switching power among a plurality of feeds.

The present invention satisfies these needs.

SUMMARY OF THE INVENTION

To address the requirements described above, and to overcome other limitations that will become apparent upon reading and understanding the present specification, the present invention discloses an apparatus and method for transmitting signals with a phase-only reconfigurable multi-feed reflector antenna. The present invention further discloses a feed network.

In general, the reconfigurable multi-feed reflector antenna system of the present invention is achieved by employing a less complicated approach to reshape and scan the beam of a multi-feed reflector by varying only the relative excitation phase at each feed element, while maintaining a fixed signal gain at the feed elements. The phase of each element can be controlled using ordinary variable phase shifters. In addition, the system and method of the present invention may be implemented with a reflector gimbal mechanism to further extend beam coverage translations.

A reconfigurable multi-feed antenna system in accordance with the present invention comprises a reflector for reflecting RF signals having a reflector plane and a feed array comprising a plurality of feed elements wherein said feed array is defocused from said reflector focal plane, yet produces an RF wavefront substantially similar to an RF wavefront that would be produced by a feed array located at the reflector focal plane.

A feed network in accordance with the present invention comprises a BFN comprising a signal divider for dividing an input signal into a plurality of divided signals, a plurality of variable phase adjusters, each receiving one of the plurality of divided signals and outputting a phase adjusted signal, and at least one fixed gain amplifier for amplifying each phase adjusted signal and outputting an amplified signal for each phase adjusted signal. The feed network further comprises a feed array, defocused from a reflector, comprising a plurality of feed elements, each receiving an amplified signal and radiating a radiated signal, wherein the combination of the radiated signals forms a wavefront.

A method of transmitting a signal in accordance with the present invention comprises forming an RF wavefront with a feed array, wherein said feed array is defocused from a reflector focal plane, yet produces an RF wavefront substantially similar to an RF wavefront that would be produced by a feed array located at the reflector focal plane and reflecting said wavefront to a coverage area.

The foregoing allows the use of a constant value for the gain at each feed element which in turn enables three fundamental advantages of the present invention. First, the present invention provides the advantage that the amplifiers feeding the elements have a fixed operating power level, regardless of the coverage shape. Second, reconfiguring the beam coverage does not require switching power among feeds. Third, the overall antenna feed system is less complex and simpler to control than prior art systems.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Overview

The principle of the present invention is best illustrated through a comparison between a prior art multi-feed reflector antenna and the phase-only reconfigurable multi-feed antenna of the present invention.

Figure 1:
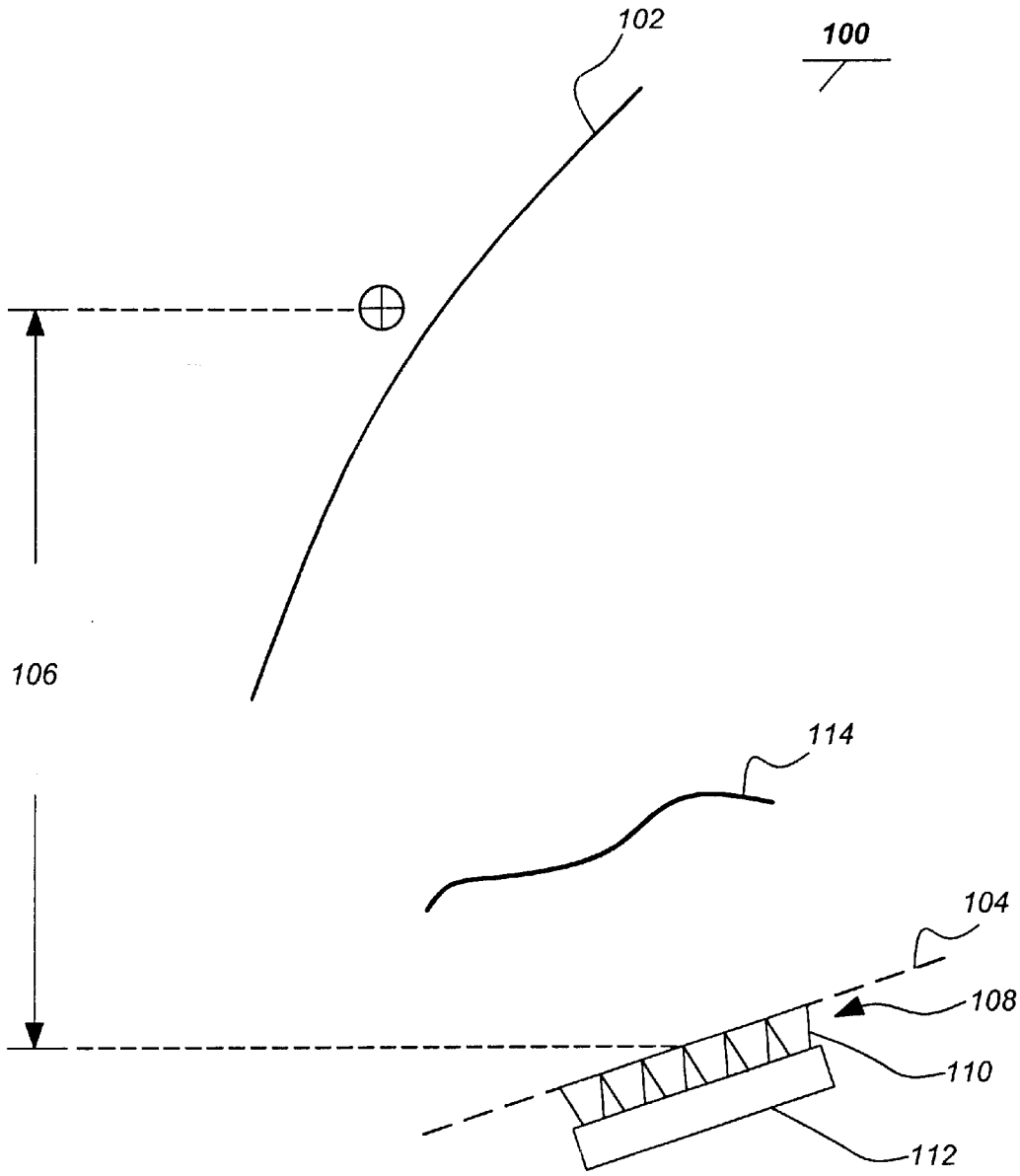
FIG. 1 (PRIOR ART)
FIG. 1 illustrates a reconfigurable multi-feed reflector antenna system of the prior art.

FIG. 1 illustrates a reconfigurable multi-feed reflector antenna system 100 of the prior art. The feed array 108 is comprised of a plurality of feed horns or radiating elements (hereinafter, feed elements 110) arranged in a grid pattern, preferably a hexagonal pattern. The feed array 108 is located at the reflector focal plane 104 at an offset 106 distance. Signals are delivered to the individual feed elements 110 through a beam forming network 112 (BFN). The feed array 108 produces a wavefront 114 which is reflected off the reflector 102 to a coverage area. Importantly, there is direct correspondence between each feed element 110 positioned at the reflector focal plane 104 and the beam location produced by that feed element 110 on the coverage area.

Figure 2A:
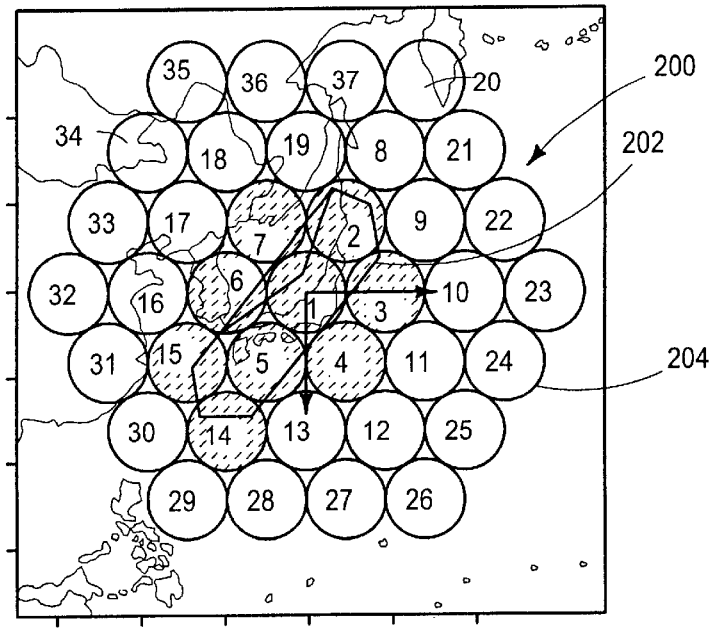
FIG. 2A Prior Art
FIGS. 2A–2B are example mappings of the feed elements to the coverage of Japan of a prior art reconfigurable multi-feed antenna at a spacecraft yaw of 0° and −90°, respectively.
Figure 2B:
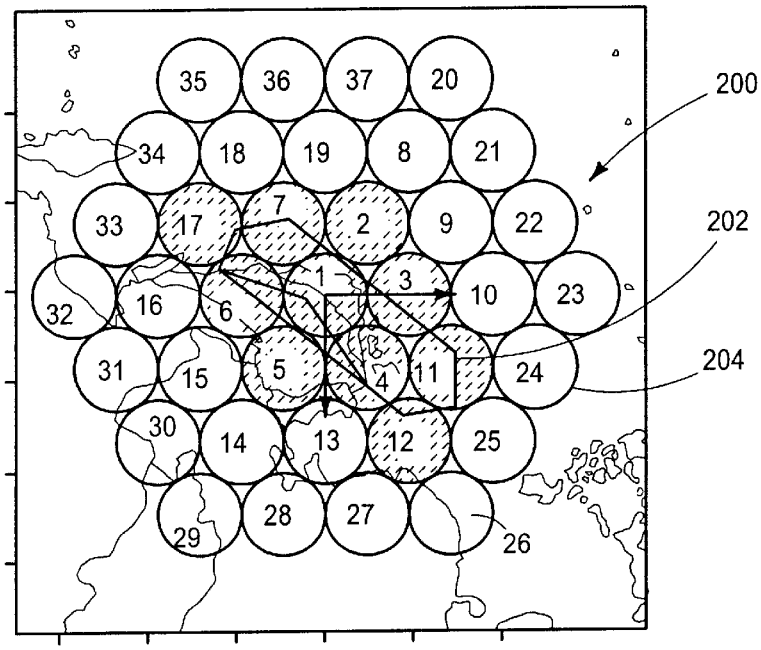
FIG. 2B Prior Art

FIGS. 2A–2B are example mappings of the feed element coverage of Japan of a prior art reconfigurable multi-feed antenna at a spacecraft yaw of 0° and −90°, respectively. Such spacecraft reorientation may occur when a spacecraft is in a highly elliptical orbit and the spacecraft yaw orientation must vary continuously by up to 360° to align the solar panels with the sun. Of the thirty-seven (37) feed elements 110 blanketing the overall coverage area 200, only those feed elements 110 which project beams 204 to the receiving coverage area 202 are activated to optimize the performance of the system.

For example, in FIG. 2A the active feed elements 110 correspond to beams 204 numbered 1–7, 14 and 15. To produce the receiving coverage area 202 an RF signal is distributed with the proper gain and phase among the active feed elements 110 through a BFN. The remaining feed elements 110, corresponding to beams 204 numbered 8–13 and 16–37, are not used.

In FIG. 2B, a reorientation of the spacecraft to a yaw of −90° necessitates a redistribution of the active feed elements 110. The active feed elements 110 now correspond to beams 204 numbered 1–7, 11 and 12, with the remaining feed elements inactive. In general, each time the coverage is rotated or translated with respect to the antenna boresight, the power must be redistributed among the feed elements 110 to maintain proper coverage. A BFN which supports the task of redistributing the power can be very complex. The present invention eliminates the need for such a BFN.

Principle of the Present Invention

Figure 3A:
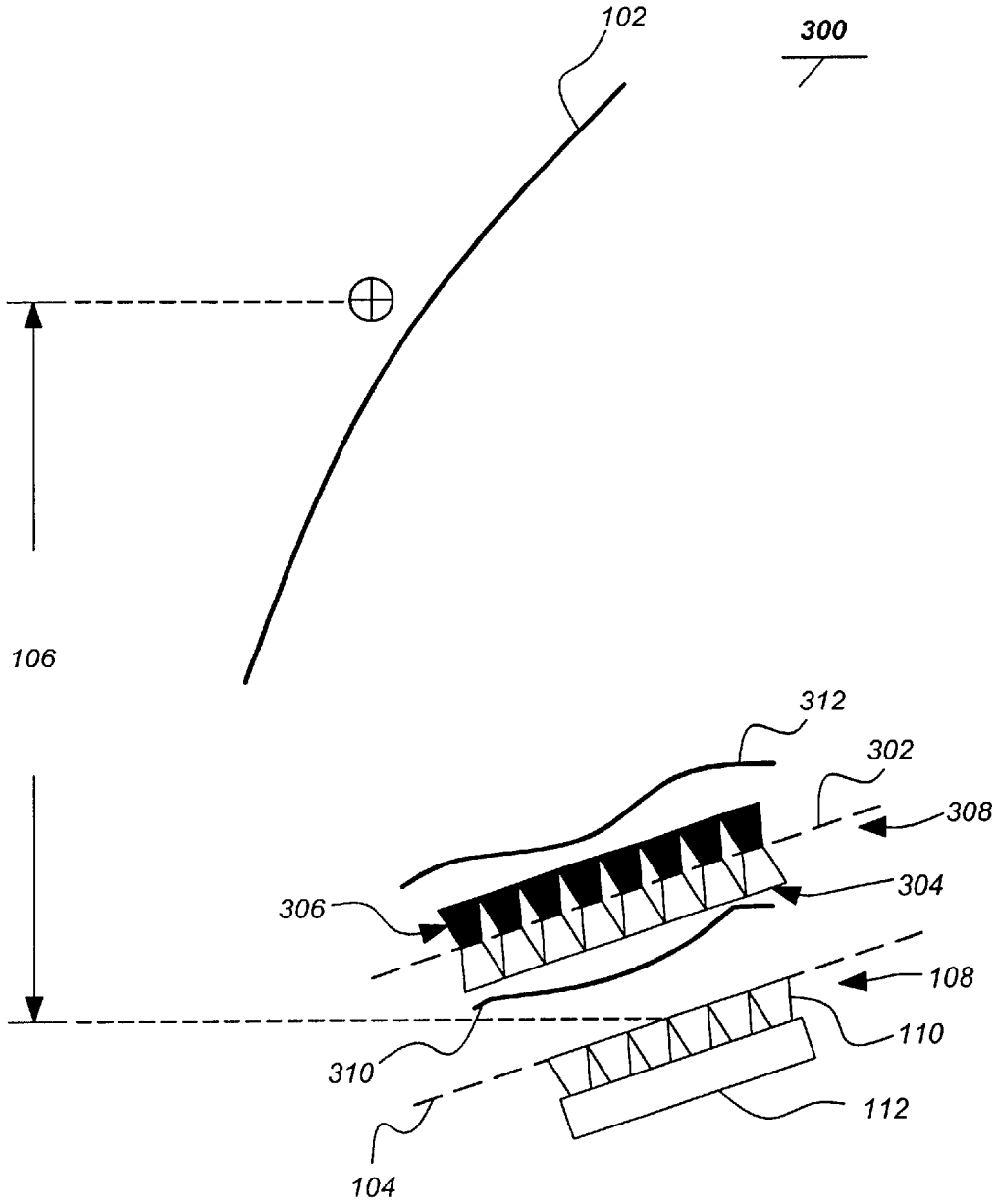
FIGS. 3A–3B illustrate the principle of the reconfigurable phase-only multi-feed reflector antenna system of the present invention.
Figure 3B:
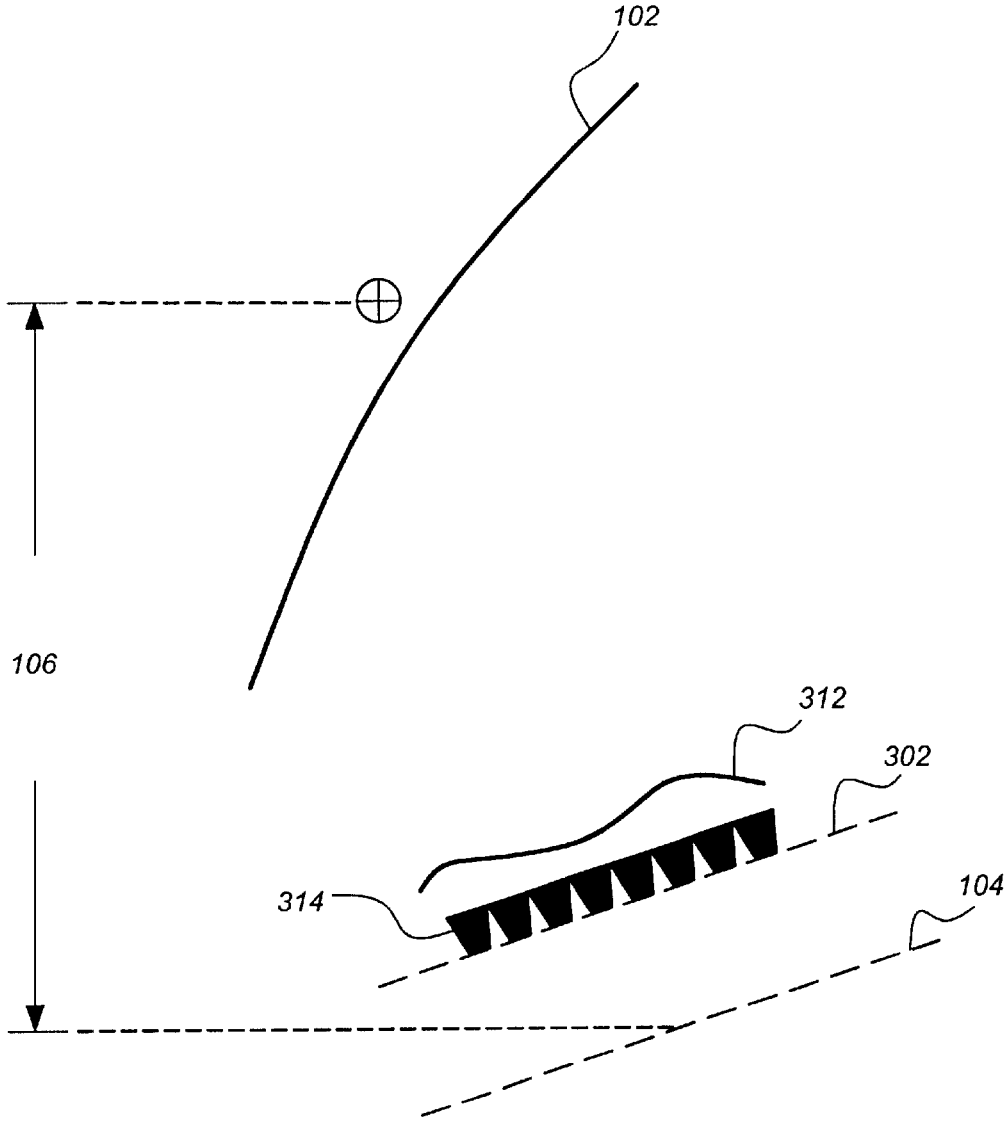

FIGS. 3A and 3B illustrate the principle of the reconfigurable phase-only multi-feed reflector antenna system. FIG. 3A depicts a multi-feed reflector antenna system 300. Feed elements 110 of a prior art feed array 108 are located at the reflector focal plane 104. A repeater device 308 located at a defocused plane 302 intercepts a cone angle between the feed array 108 and the outside rim of the reflector 102. The repeater device 308 receives an incoming wavefront 310 from the feed array 108 at a receiver array 304 and repeats it at discrete points from a transmit array towards the reflector 102. The illumination of each feed element 110 on the repeater device 308 is closely Gaussian with a maximum around the center of the repeater device 308.

FIG. 3B depicts the feed array 314 and reflector 102 configuration of the present invention. The original feed array 108 and the repeater device 308 are replaced by a single feed array 314 located at the same defocused plane 302. The new feed array 314 is designed to substantially reproduce the wavefront 312 as would have been produced by the original feed array 108 (as shown in FIG. 1, wavefront 114). The defocused plane 302 must be positioned to allow enough sampling points on the wavefront while maintaining a feed element size larger than at least one wavelength to reduce mutual coupling effects.

Configuration of the Present Invention

Figure 4:
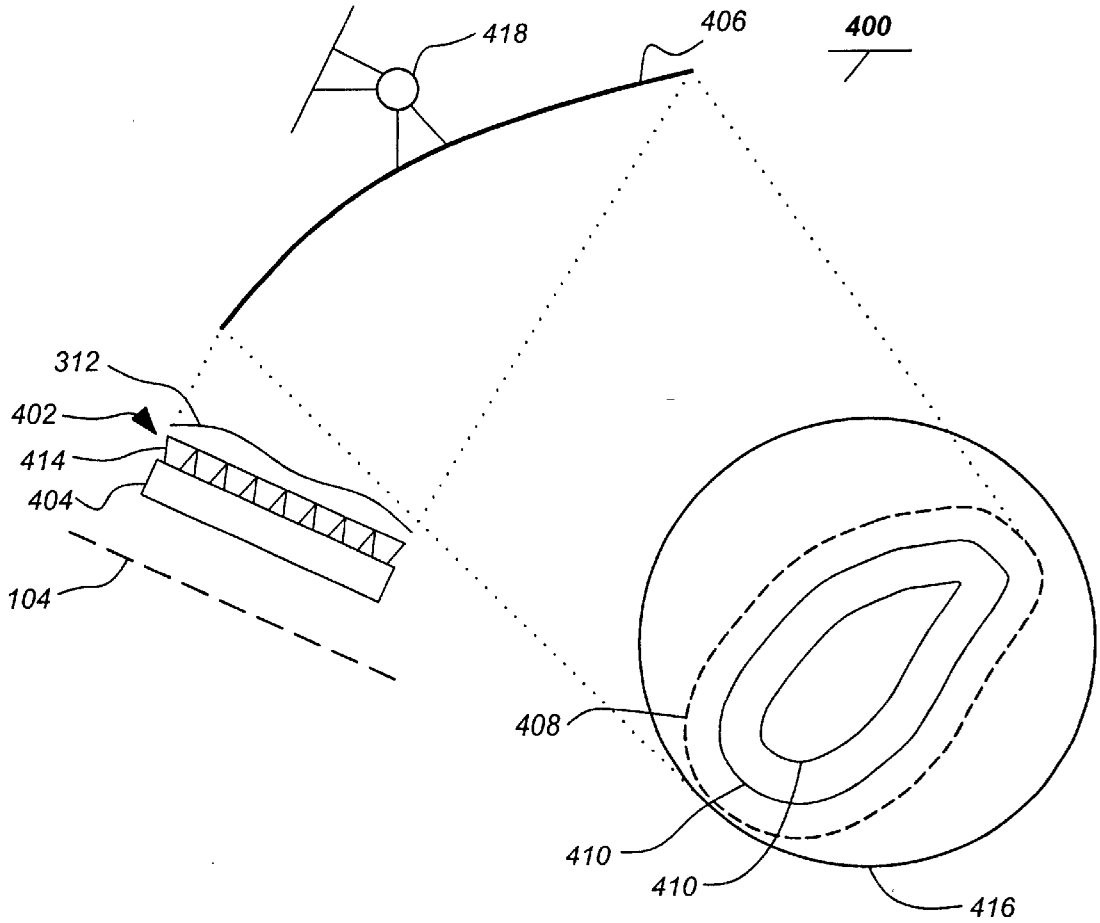
FIG. 4 illustrates the reconfigurable phase-only multi-feed reflector antenna system of the present invention.

FIG. 4 illustrates the reconfigurable phase-only multi-feed reflector antenna system 400. The feed array 402 is positioned in a defocused plane 302 from the focal plane 104 of the reflector 406. The defocusing of each feed element 414 broadens the beam that it produces, allowing coverage of substantially the entire potential coverage area 416. The combination of the contributions of each feed element 414 after proper phasing between them, produces a wavefront 312 of a shaped beam concentrated only on the desired geographical area within the coverage area 408. The BFN 404 delivers signals to each feed element 414 at a fixed gain but with a variable phase to produce a wavefront 312. The wavefront 312 is reconfigured by the BFN 404 through reconfiguration of the variable phase adjusters of the BFN 404. When the shape of the desired coverage area changes, due to a satellite maneuver or for any other reason, the phase of the BFN 404 can be reconfigured to concentrate the beam on the new coverage area. The wavefront 312 reflects off the reflector 406 to a coverage area 408, producing antenna directivity contours 410 representing varying signal strength across the coverage area 408.

In one embodiment, the power at each feed element 414 is fixed with an imposed circularly symmetric taper at the feed array 402 with a maximum at the center of the feed array 402. For example, in a thirty-seven element hexagonal array, a taper of −8 dB may be used. The seven center feed elements 414 operate at 0 dB, the surrounding twelve feed elements 414 operate at −4 dB and the outermost eighteen feed elements 414 operate at −8 dB. The phase of each feed element 414 is selected to optimally blanket the coverage area 408.

Reconfiguration of the variable phase adjusters of the BFN 404 can alter both the shape and the scan of the coverage area 408. In addition, the scan of the coverage area may be further extended through the use of a gimbal mechanism 412.

Importantly, the reflector geometry must accommodate a sufficiently large offset 414 with respect to the focal axis of the reflector 406, yet allow enough room for feed defocusing without obstructing the reflector 406.

Figure 5:
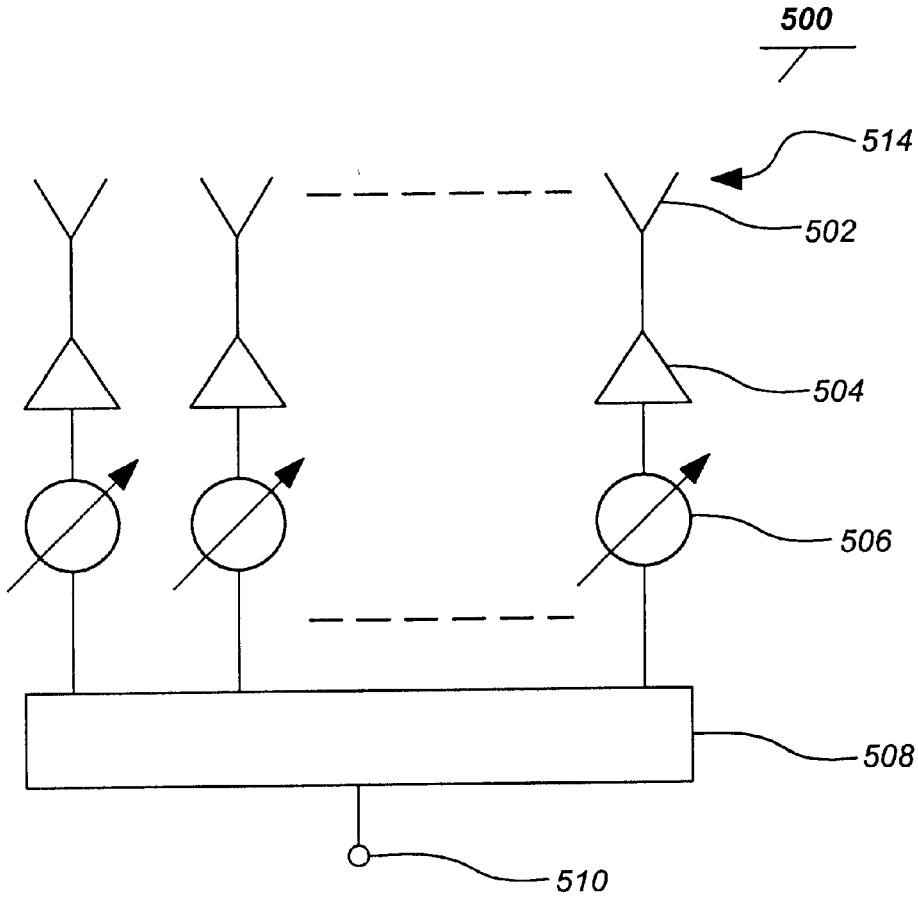
FIG. 5 is a block diagram of the feed network of the present invention.

FIG. 5 is a block diagram of the feed network of the present invention. The feed network 500 of the present invention comprises a BFN 512 and a feed array 514. A signal is applied at the input 510 to a signal divider 508 of the BFN 512. The signal divider 508, which may be a passive signal divider, appropriately divides the signal among the feed elements 502 of the feed array 514. Each divided signal is directed to a variable phase adjuster 506 and a fixed gain amplifier 504 before arriving at the appropriate feed element 502. In a preferred embodiment, the variable phase adjusters 506 will perform five-bit shifting quantization.

Although FIG. 5 depicts an individual fixed gain amplifier 504 for each feed element 502, such an arrangement is not required. Equivalent systems may incorporate a fixed gain amplifier system wherein more than one of the signals are amplified by a single amplifier.

Example Coverage Mappings of the Present Invention

Figure 6A:
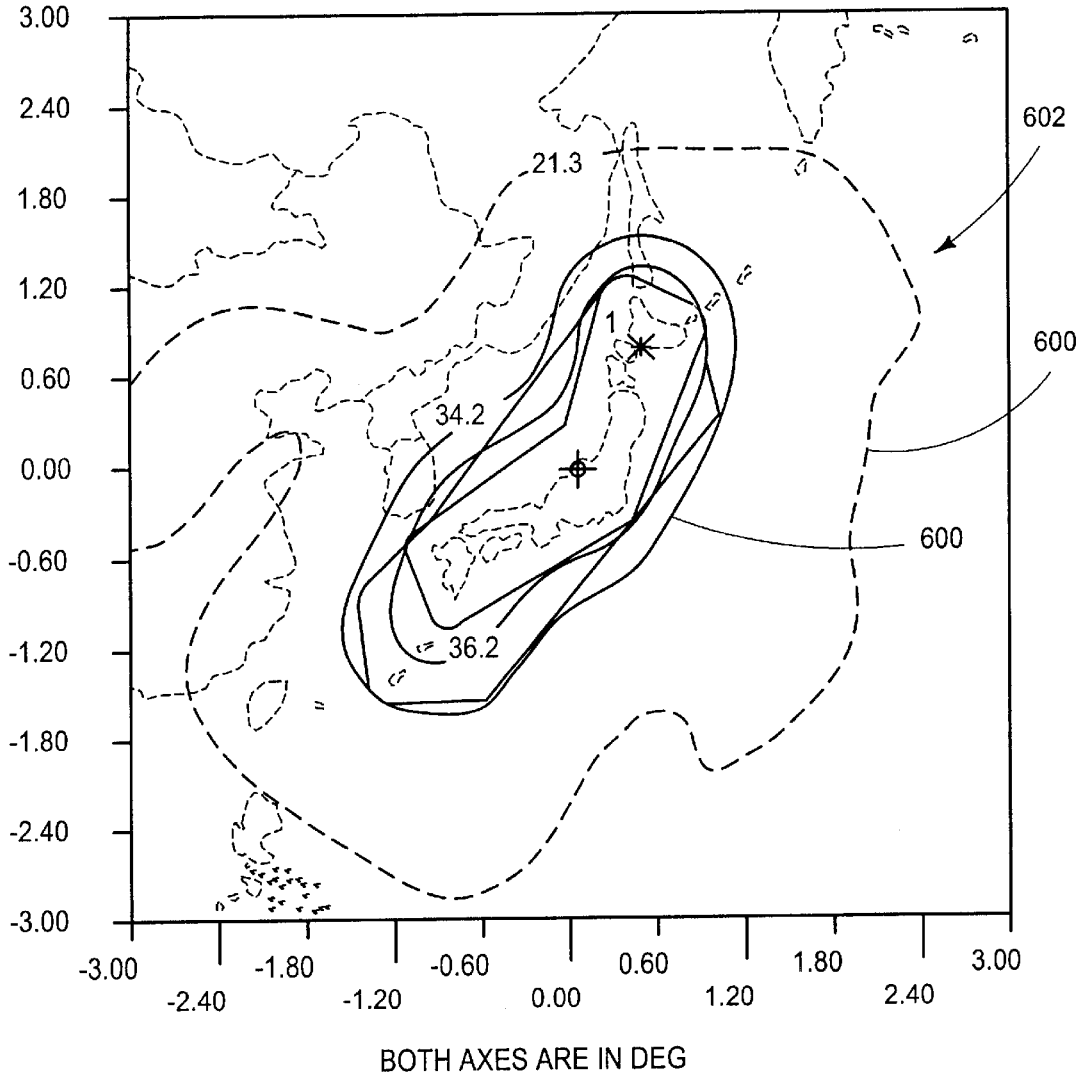
FIGS. 6A–6B are example mappings of the coverage of Japan at a spacecraft yaw of 0° and −90°, respectively, of a reconfigurable phase-only multi-feed reflector antenna system of the present invention showing antenna directivity contours.
Figure 6B:
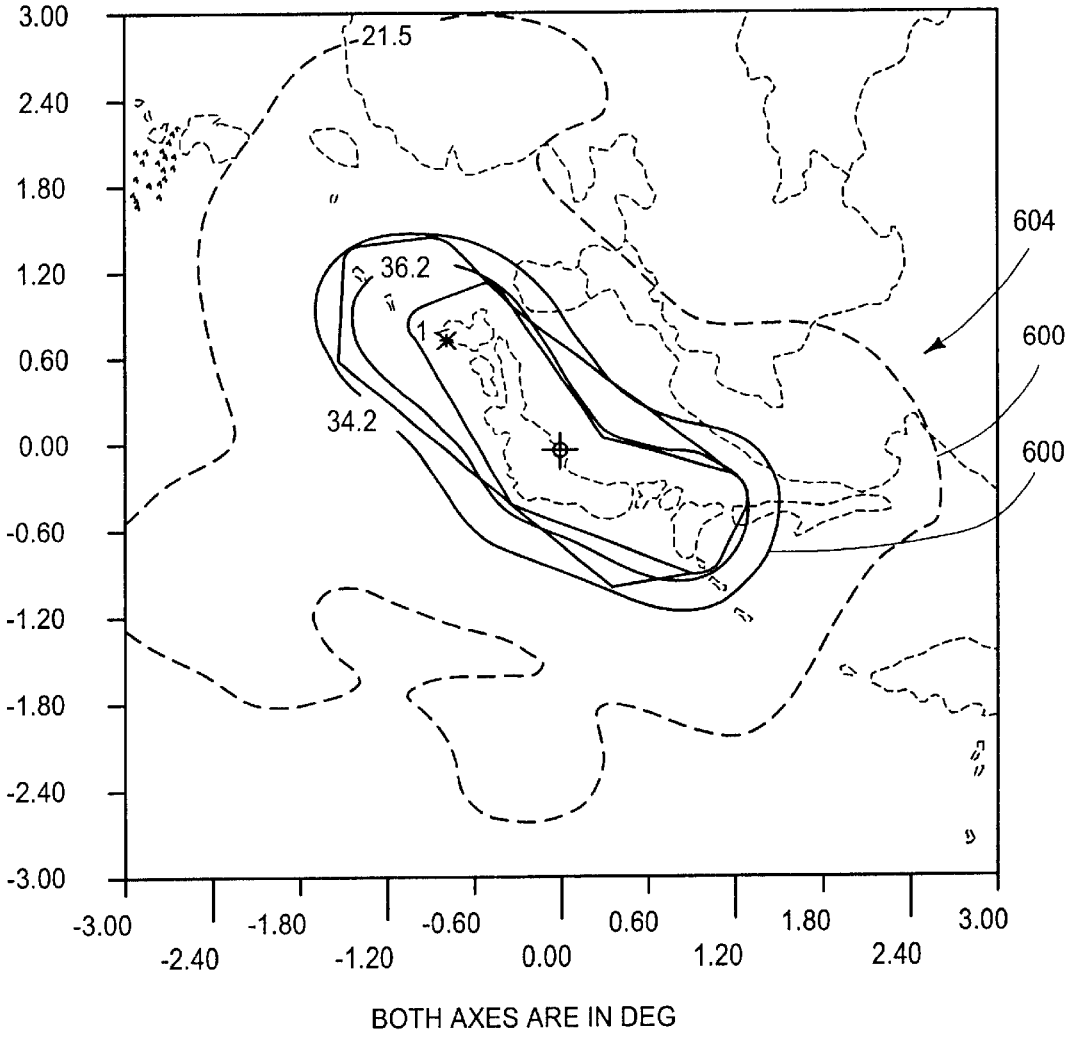

FIGS. 6A–6B are example mappings of the coverage of Japan at varying spacecraft yaw by a reconfigurable phase-only multi-feed reflector antenna system of the present invention showing antenna directivity contours 600. FIG. 6A depicts the coverage area shape 602 using a phase-only multi-feed reflector antenna of the present invention at a spacecraft yaw of 0°. FIG. 6B depicts the coverage area shape 604 reconfigured to accommodate a spacecraft yaw of −90°.

Figure 7:
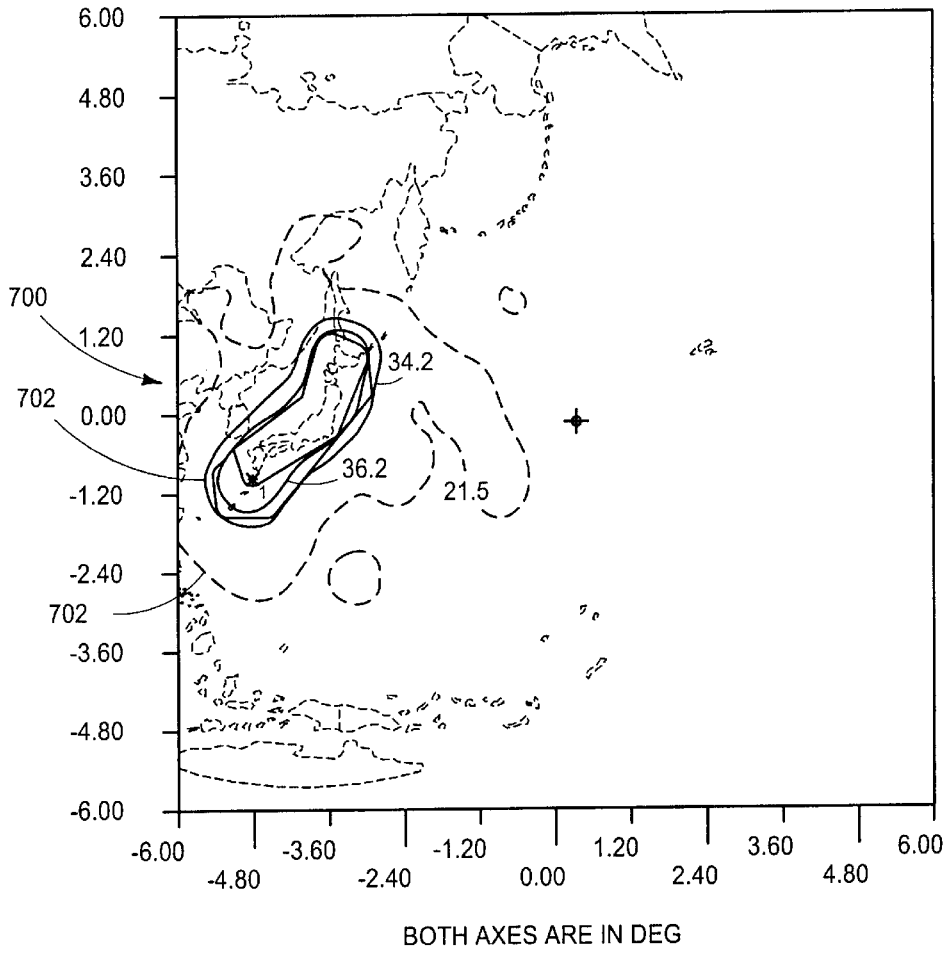
FIG. 7 is an example mapping of the coverage of Japan of a reconfigurable phase-only multi-feed reflector antenna system of the present invention with the reflector gimbaled by 2° showing antenna directivity contours.

FIG. 7 is an example mapping of the coverage of Japan at a high scan by a reconfigurable phase-only multi-feed reflector antenna system of the present invention showing antenna directivity contours 702. To achieve the coverage area shape 700 with the antenna boresight shifted by 4° east of the original position, the reflector was first gimbaled by 2° to repoint the reflector boresight before reconfiguring the variable phase adjusters of the BFN to further alter the coverage shape and scan.

Figure 8:
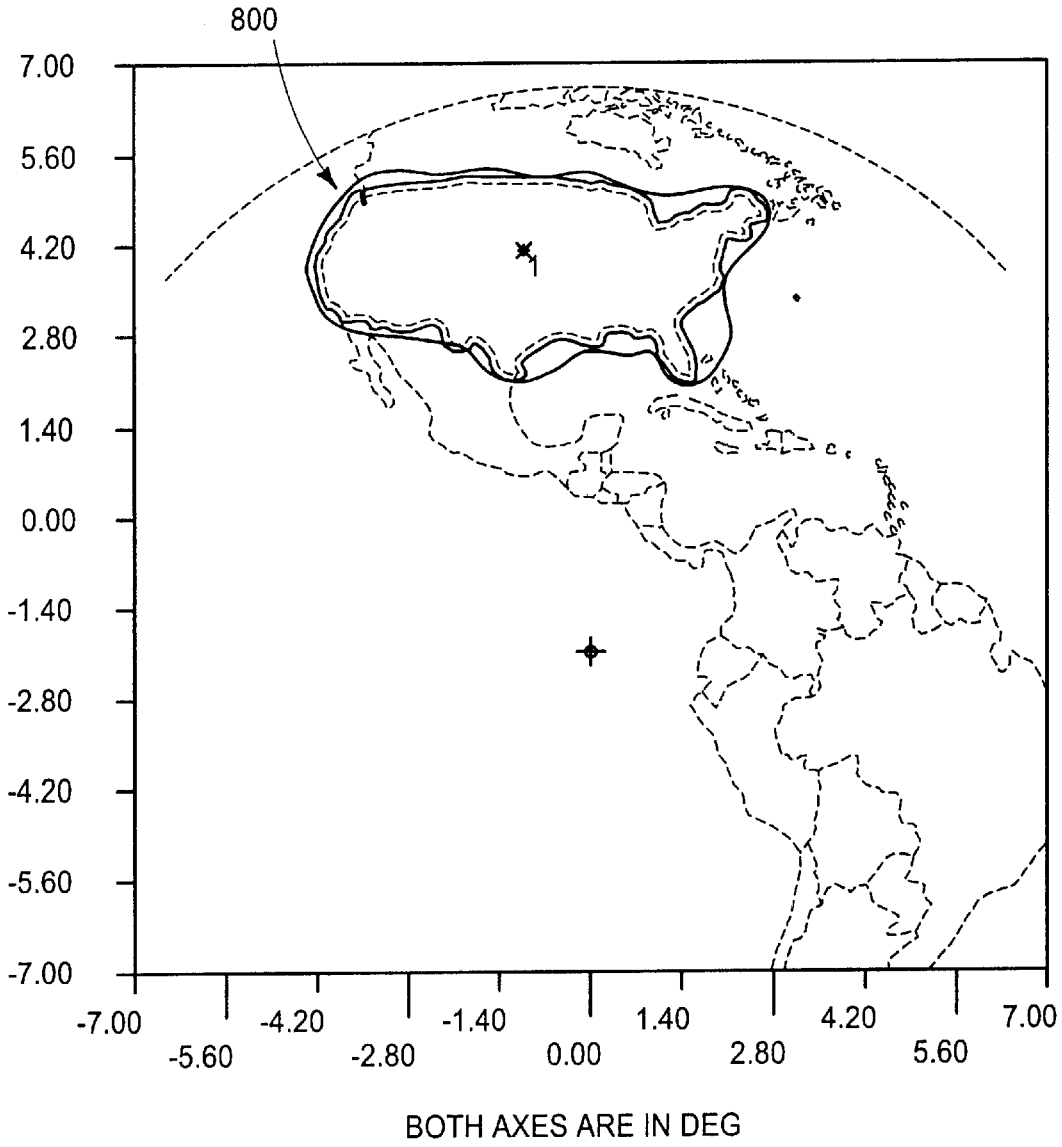
FIG. 8 is an example mapping of the CONUS coverage at a spacecraft yaw of 0° of a reconfigurable phase-only multi-feed reflector antenna system of the present invention with the reflector gimbaled by 3° showing antenna directivity contours.

FIG. 8 is an example mapping of the CONUS coverage shape 800 at a spacecraft yaw of 0° of a reconfigurable phase-only multi-feed reflector antenna system of the present invention. The reflector is first gimbaled by 3° before reconfiguring the variable phase adjusters of the BFN to further alter the coverage shape and scan.

Those skilled in the art will recognize many modifications may be made to this configuration without departing from the scope of the present invention. For example, those skilled in the art will recognize that any combination of the above components, or any number of different components, and other devices, may be used with the present invention.

Conclusion

This concludes the description of the preferred embodiments of the present invention. In summary, the present invention describes an apparatus and method for a phase-only reconfigurable multi-feed reflector antenna system. The present invention provides the advantage that feed element amplifiers have a fixed operating power level, regardless of the coverage shape. The present invention also provides the advantage that reconfiguring the beam coverage does not require switching power among feed elements. In addition, the present invention provides the advantage that the overall antenna feed system is less complex and simpler to control than prior art systems. The present invention combines the reconfiguration flexibility of a phased array antenna with the concentrating efficiency of a large reflector antenna, but with much fewer elements than would normally be required by an ordinary phased array antenna.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An antenna system for transmitting a signal comprising:

a reflector for reflecting a signal beam having a reflector focal plane; and a feed array for producing a wavefront substantially similar to a wavefront that would be produced by a feed array located at said reflector focal plane, the feed array including a plurality of feed elements;

a Beam Forming Network (BFN) having a variable phase shifter for each signal of said feed elements wherein the wavefront is produced by varying only a phase for each signal of said feed elements while a gain of each signal remains substantially fixed; and at least one amplifier amplifying each phase shifted signal of each of said plurality of feed elements by a substantially fixed gain.

2. The antenna system of claim 1, wherein each said variable phase shifter performs phase shifting of at least five-bit quantization.

3. The antenna system of claim 1, wherein said reflector reflects the wavefront to a coverage area, said coverage area being reconfugurable in shape and scan by reconfiguring said variable phase shifters.

4. The antenna system of claim 1, wherein the feed element size is greater the one wavelength.

5. The antenna system of claim 1, wherein the at least one amplifier produces a substantially circularly symmetric taper at the feed array with a maximum at a center of the feed array.

6. The antenna system of claim 1, wherein the reflector possesses an offset with respect to a focal length of the reflector allowing the feed array to be defocused without substantially blocking the reflector.

7. The antenna system of claim 1, further comprising a reflector gimbal mechanism for repainting a boresight of the reflector.

8. The antenna system of claim 7, wherein said reflector gimbal mechanism provides at least ±2° of range for repointing the boresight of the reflector.

9. A method of transmitting a signal comprising:

forming a wavefront with a feed array, wherein said feed array is defocused from a reflector focal plane yet produces a wavefront substantially similar to a wavefront that would be produced by a feed array located at the reflector focal plane, the step of forming further comprising the substeps of:

varying only the phase for each signal of a plurality of feed elements in a Beam Forming Network (BFN) while a gain of each signal remains substantially fixed; and amplifying each signal of the plurality of feed elements by a substantially fixed gain to produce the wavefront; and reflecting said wavefront to a coverage area.

10. The method of claim 9, wherein phase shifting is performed with at least five-bit quantization.

11. The method of claim 9, wherein said coverage area is reconfigurable in shape and scan by variably phase shifting the signal at each of said plurality of feed elements.

12. The method of claim 9, wherein the feed element size is greater than one wavelength.

13. The method of claim 9, wherein amplifying the signal at a fixed gain produces a substantially circularly symmetric taper with a maximum at a center of the taper.

14. The method of claim 9, wherein reflecting the wavefront is performed with an offset with respect to a focal axis of the reflector allowing the feed array to be defocused without substantially blocking the reflector.

15. The method of claim 9, further comprising repointing a boresight of the reflector.

16. The method of claim 15, wherein said reflector boresight is repointed with a range of at least ±2°.

17. An antenna feed network comprising:

a Beam Forming Network (BFN) having:

a signal divider for dividing an input signal into a plurality of divided signals;

a plurality of variable phase adjusters, said variable phase adjusters each receiving one of the plurality of divided signals and outputting a phase adjusted signal; and at least one fixed gain amplifier for amplifying each phase adjusted signal by a fixed gain and outputting an amplified signal for each phase adjusted signal;

a feed array defocused from a reflector, said feed array comprising a plurality of feed elements, each feed element receiving the amplified signal and radiating a radiated signal, the combination of the radiated signals of each feed element forming a wavefront;

wherein the feed array produces the wavefront by varying only a phase for each divided signal of said feed elements while a gain of each divided signal remains substantially fixed.

18. The antenna feed network of claim 17, wherein each said variable phase shifter performs phase shifting of at least five-bit quantization.

19. The antenna feed network of claim 17, wherein said reflector reflects the wavefront to a coverage area, said coverage area being reconfigurable in shape and scan by reconfiguring said variable phase shifters.

20. The antenna feed network of claim 17, wherein the feed element size is greater than one wavelength.

21. The antenna feed network of claim 17, wherein the at least one amplifier produces a substantially circularly symmetric taper at the feed array with a maximum at a center of the feed array.

22. The antenna feed network of claim 17, wherein the reflector possesses an offset with respect to a focal length of the reflector allowing the feed array to be defocused without substantially blocking the reflector.

23. The antenna feed network of claim 17, further comprising a reflector gimbal mechanism for repointing a boresight of the reflector.

24. The antenna feed network of claim 23, wherein said reflector gimbal mechanism provides at least ±2° of range for repointing the boresight of the reflector.

25. A wavefront produced by a feed array comprising a plurality of feed elements, wherein said feed array is defocused from a reflector focal plane yet produces a wavefront substantially similar to a wavefront that would be produced by a feed array located at the reflector focal plane;

wherein the feed array produces the wavefront by varying only a phase for a signal to each of said feed elements while a gain of each signal remains substantially fixed.

26. An antenna system for transmitting a signal comprising;

a means for reflecting signal having a focal plane; and a means for generating a signal wavefront with a plurality of feed elements substantially similar to a wavefront that would be produced by a feed array located at said focal plane;

wherein the means for generating the signal wavefront produces the wavefront by varying only a phase for a signal to each of said feed elements while a gain of each signal remains substantially fixed.

* * * * *